US011202511B2

(12) United States Patent
Kim et al.

(10) Patent No.: US 11,202,511 B2
(45) Date of Patent: Dec. 21, 2021

(54) SEAT LOCK

(71) Applicants: CJ CGV CO., LTD., Seoul (KR); HYESUNG MFG. CO., LTD., Incheon (KR)

(72) Inventors: Sang Kyu Kim, Seoul (KR); Jang Soo Kim, Seoul (KR); Young Su No, Seoul (KR); Hyun Jong Baek, Seoul (KR); Geum Sang Yoo, Seoul (KR); Sang Heon Lee, Seoul (KR); Ja Bin Lee, Seoul (KR); Young Wook Choi, Seoul (KR); Matthew Han, Incheon (KR); Seo Hee Kim, Seoul (KR); Ok Sun Kim, Namyangju (KR); Dong Jin Lee, Seoul (KR); Chang Moo Heo, Seoul (KR); Jin Chul Kim, Seoul (KR); Man Soon Lim, Anyang (KR)

( * ) Notice: Subject to any disclaimer, the term of this patent is extended or adjusted under 35 U.S.C. 154(b) by 0 days.

(21) Appl. No.: 17/258,974

(22) PCT Filed: Aug. 2, 2019

(86) PCT No.: PCT/KR2019/009649
§ 371 (c)(1),
(2) Date: Jan. 8, 2021

(87) PCT Pub. No.: WO2020/027613
PCT Pub. Date: Feb. 6, 2020

(65) Prior Publication Data

US 2021/0120959 A1 Apr. 29, 2021

(30) Foreign Application Priority Data

Aug. 3, 2018 (KR) ..... 10-2018-0090725

(51) Int. Cl.
*A47C 7/60* (2006.01)
*A47C 1/121* (2006.01)

(52) U.S. Cl.
CPC ..... *A47C 7/60* (2013.01); *A47C 1/121* (2013.01)

(58) Field of Classification Search
CPC .... A47C 7/60; A47C 1/121; A47B 2220/0036
(Continued)

(56) References Cited

U.S. PATENT DOCUMENTS 2,479,361 A * 8/1949 Hower ..... A47C 7/62 297/217.1
3,889,999 A * 6/1975 Mackintosh ..... A47C 1/12 297/248
(Continued)

FOREIGN PATENT DOCUMENTS

FR 1019490 A * 1/1953 ..... A47C 1/121
KR 100531030 B1 11/2005
(Continued)

*Primary Examiner* — Milton Nelson, Jr.
(74) *Attorney, Agent, or Firm* — Harvest IP Law, LLP

(57) ABSTRACT

The present invention relates to a seat lock including: a fixed bracket fixed to a leg of a chair; a locking unit disposed on the fixed bracket; and a movable bracket fixed to a seat of the chair in such a manner as to rotate together with the seat and having a seat rotation shaft and a locking piece coupled to an end periphery of the seat rotation shaft in such a manner as to be exposed to the outside, wherein the locking unit includes a driving motor having a driving shaft, a driving cam fitted to the driving shaft of the driving motor, and a latch rotating in a range of a given angle around a shaft fixed to the fixed bracket to limit the rotational movement of the locking piece. According to the present invention, the seat lock can utilize the locking unit to allow the seat to be more efficiently managed.

9 Claims, 15 Drawing Sheets

(58) Field of Classification Search
USPC ..... 297/335
See application file for complete search history.

(56) References Cited

U.S. PATENT DOCUMENTS

| | | | | |
|---|---|---|---|---|
| 8,950,812 | B2 * | 2/2015 | Haller | B60N 2/206 297/378.12 |
| 2006/0138818 | A1 | 6/2006 | Stitt | |
| 2006/0232110 | A1 | 10/2006 | Ovadia | |

FOREIGN PATENT DOCUMENTS

| | | | |
|---|---|---|---|
| KR | 100581731 | B1 | 5/2006 |
| KR | 101199422 | B1 | 11/2012 |
| KR | 1020130093410 | A | 8/2013 |

* cited by examiner

【Figure 1】
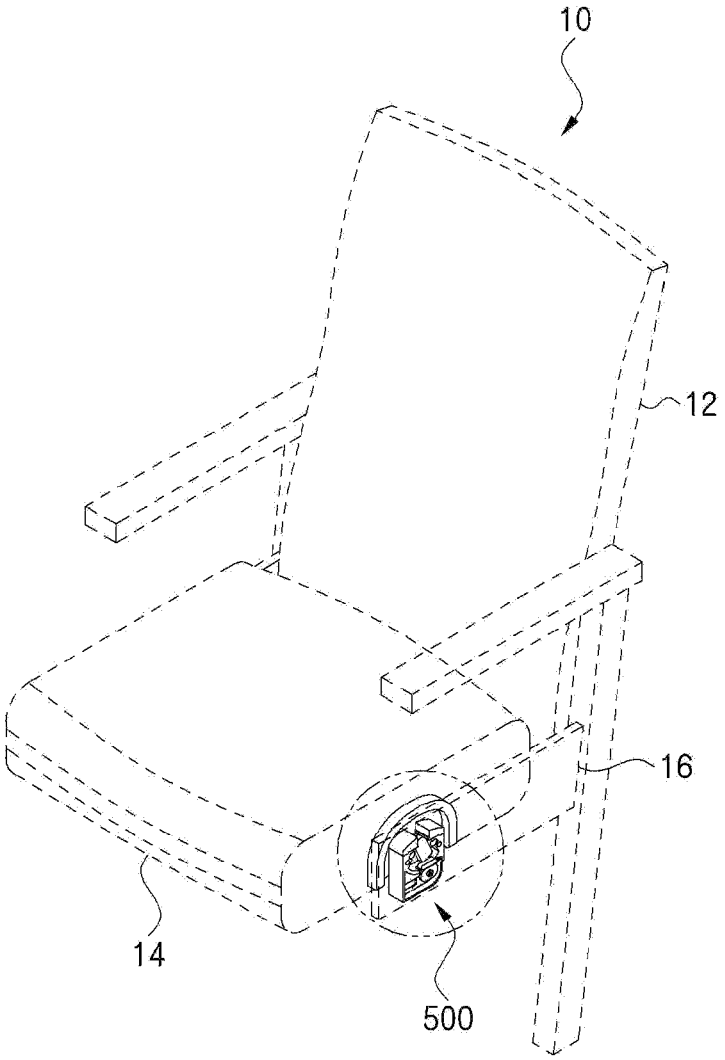

【Figure 2】
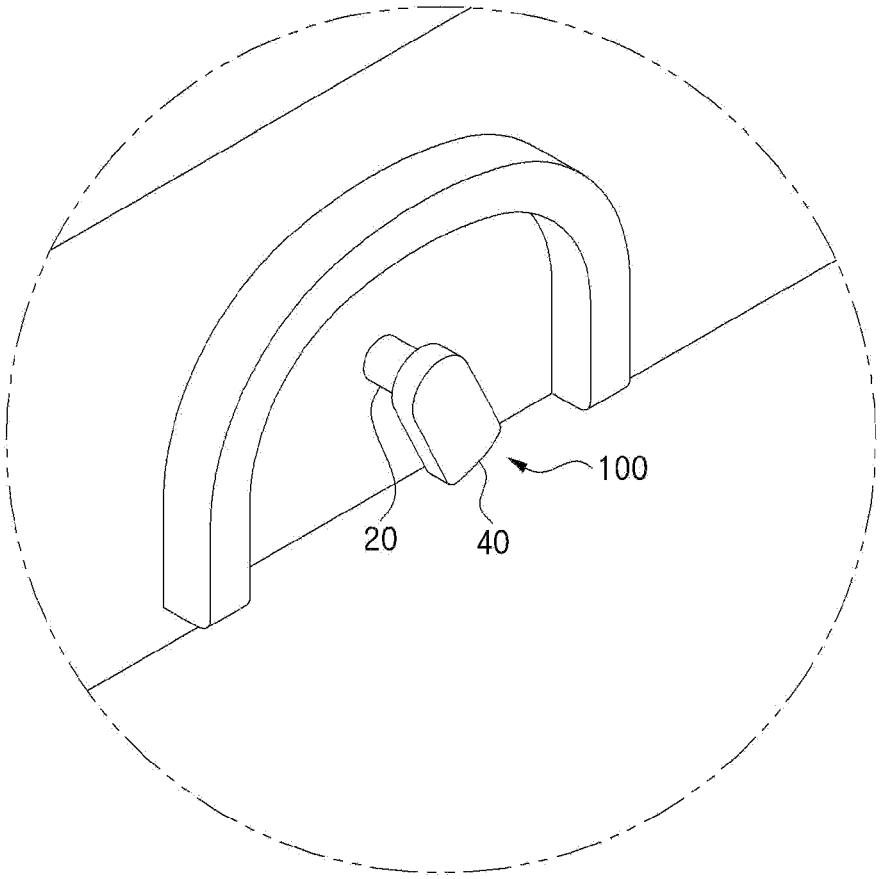

【Figure 3A】
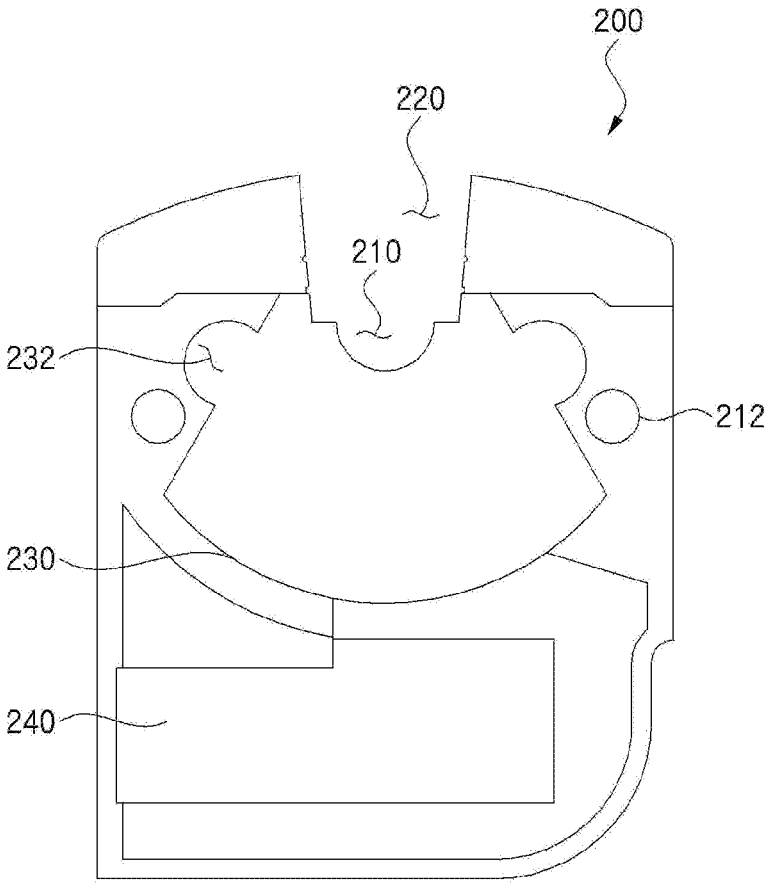

【Figure 3B】
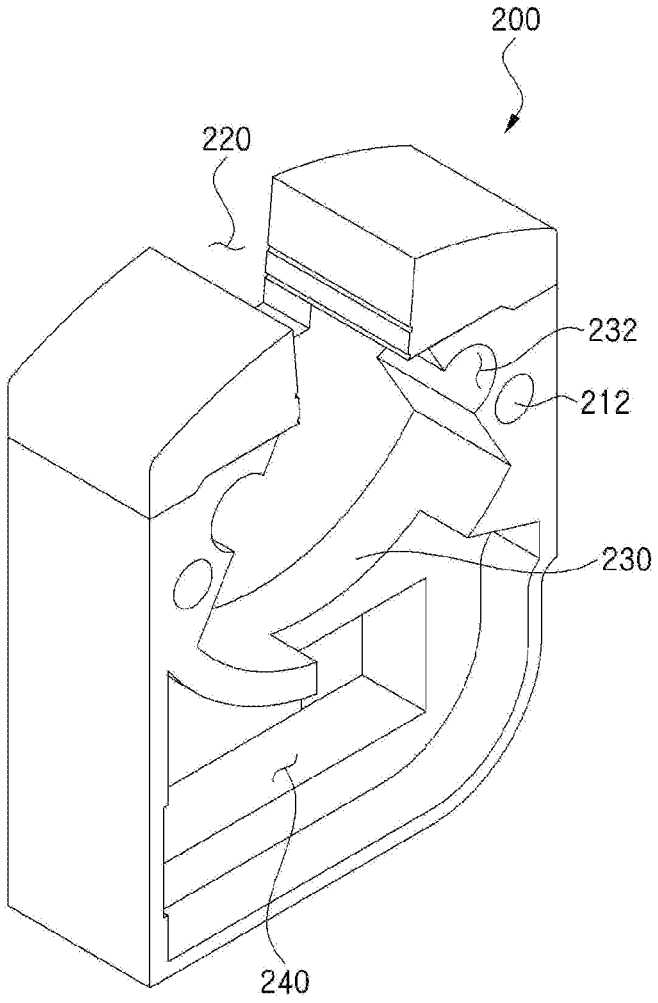

【Figure 4】
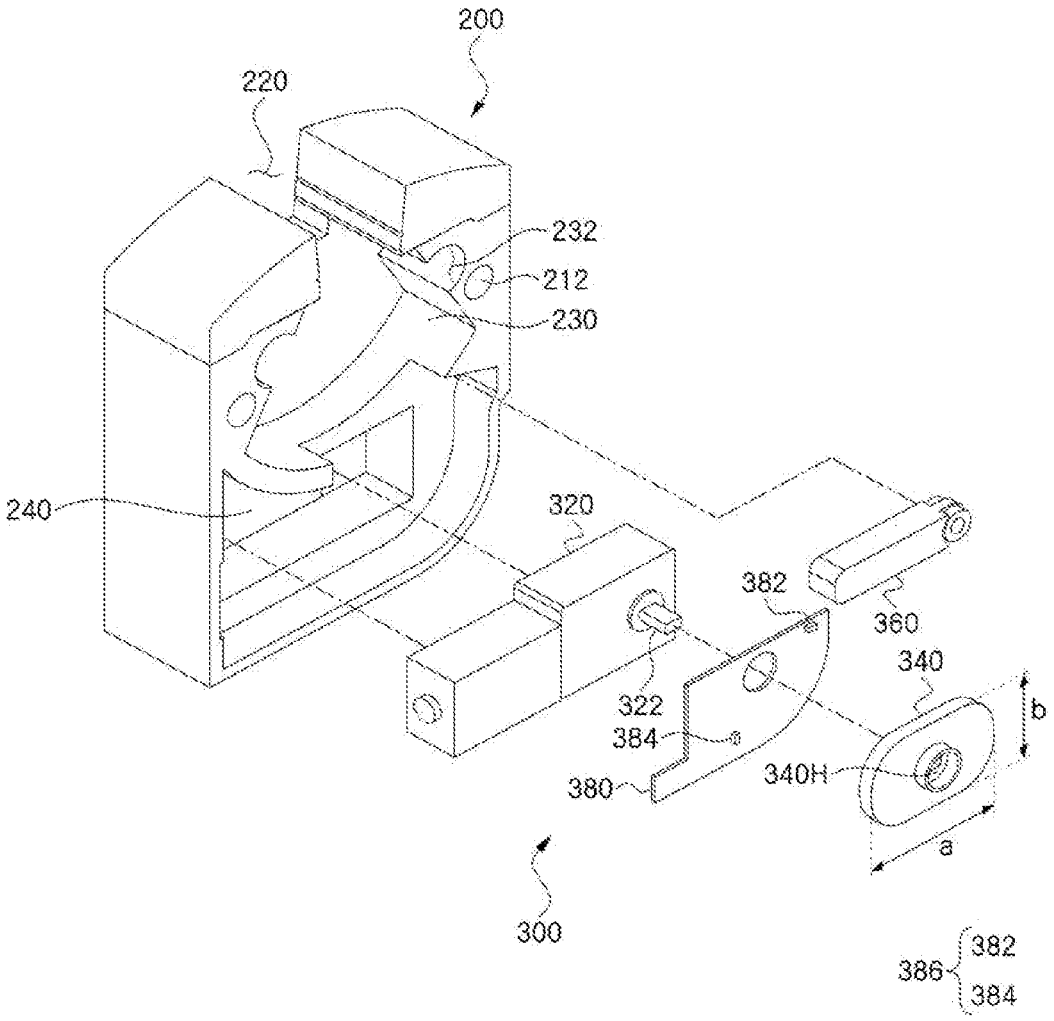

【Figure 5】
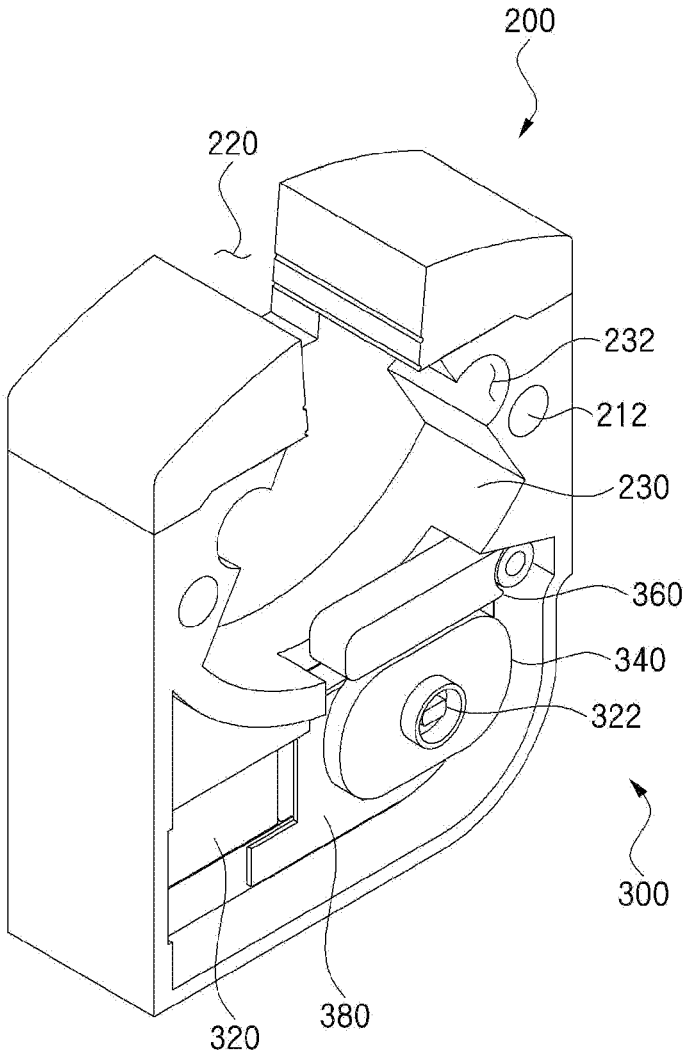

【Figure 6A】
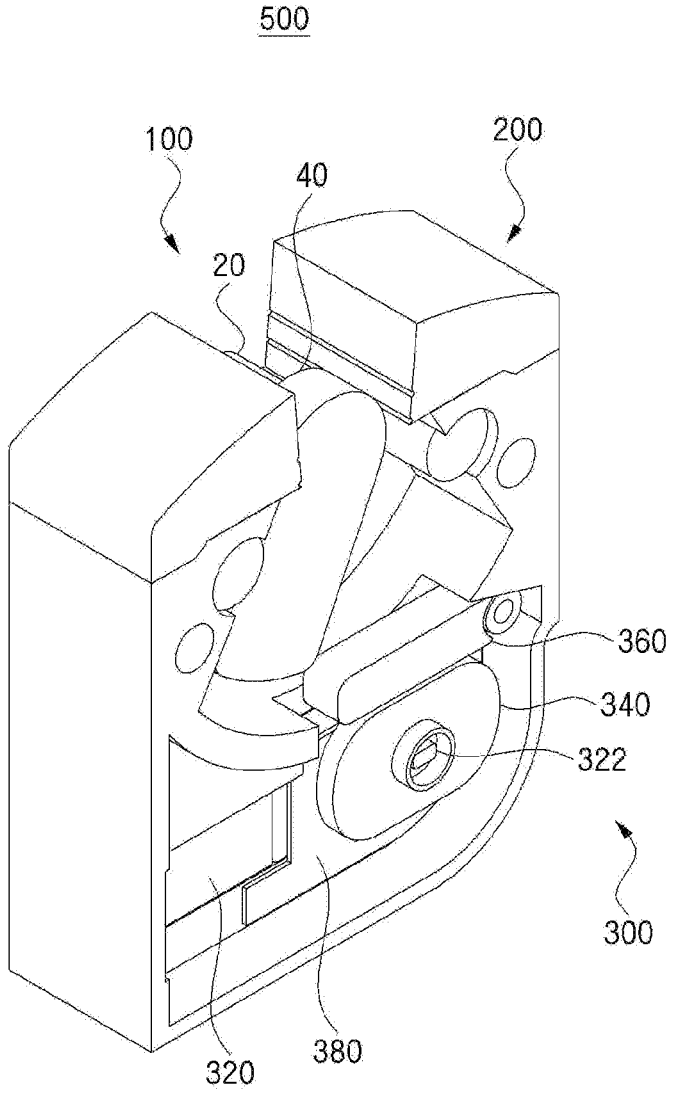

【Figure 6B】
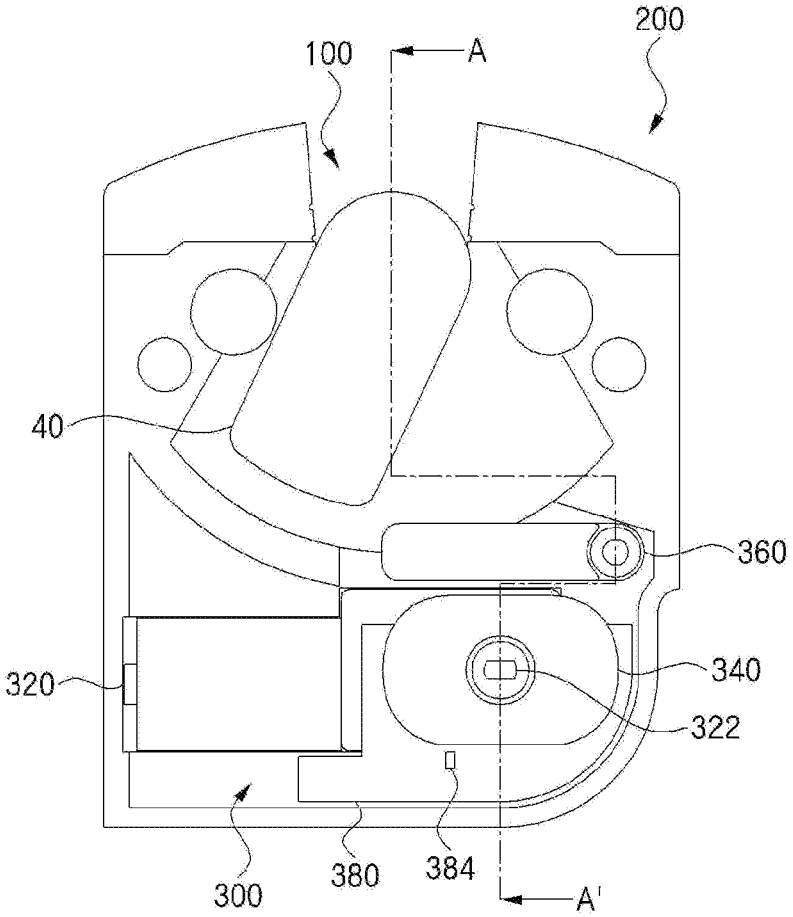

【Figure 7】
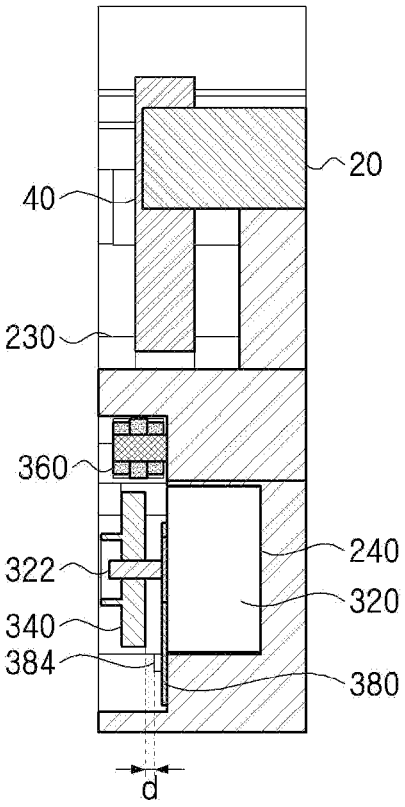

【Figure 8】
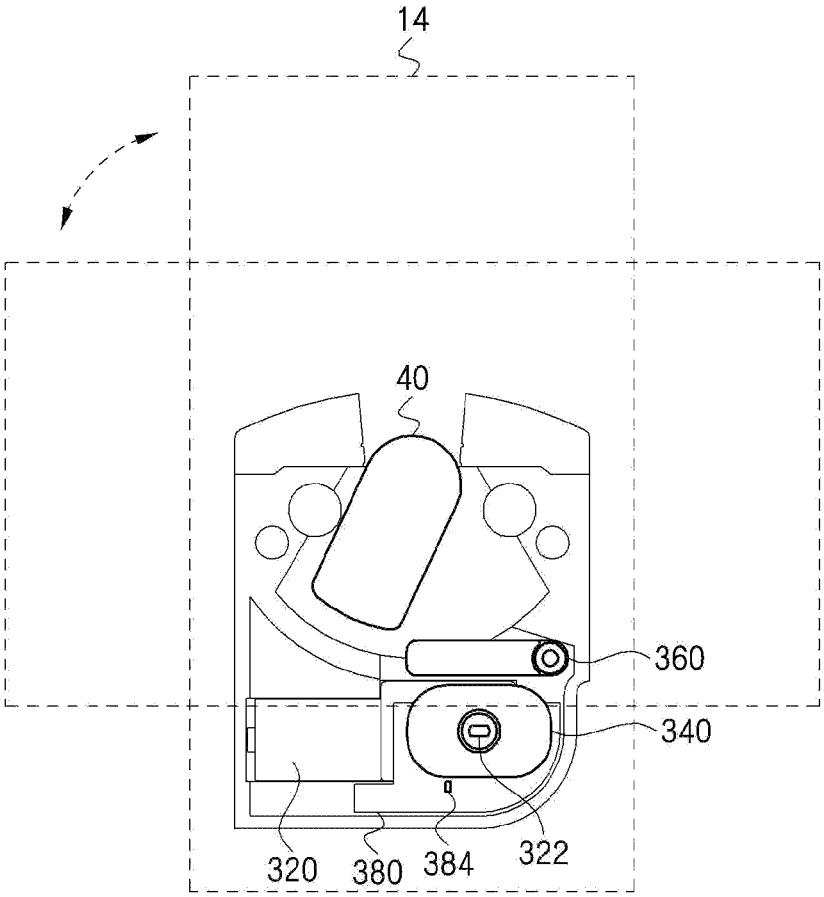

【Figure 9】
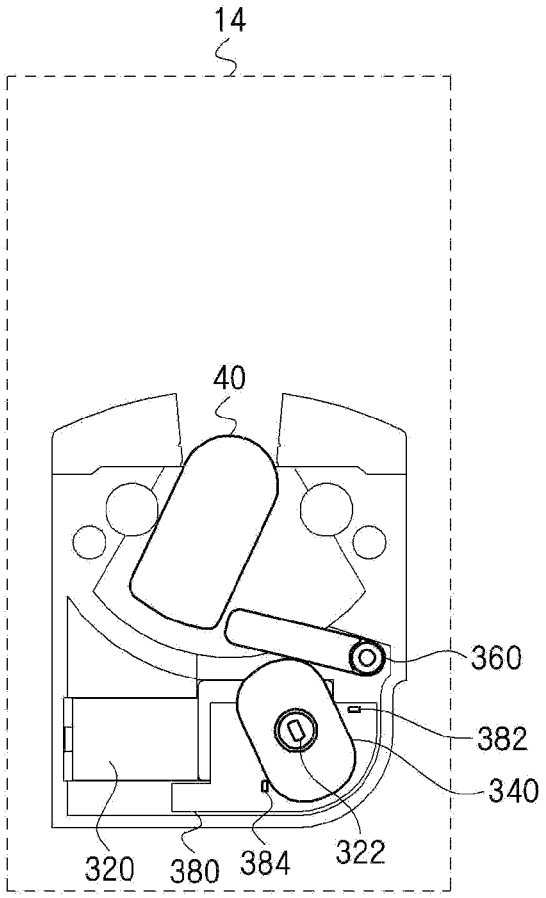

【Figure 10】
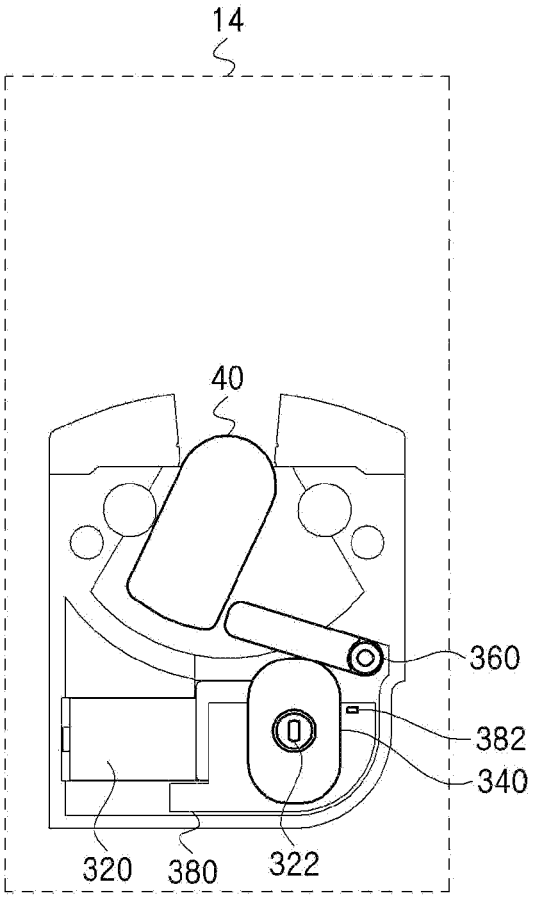

【Figure 11】
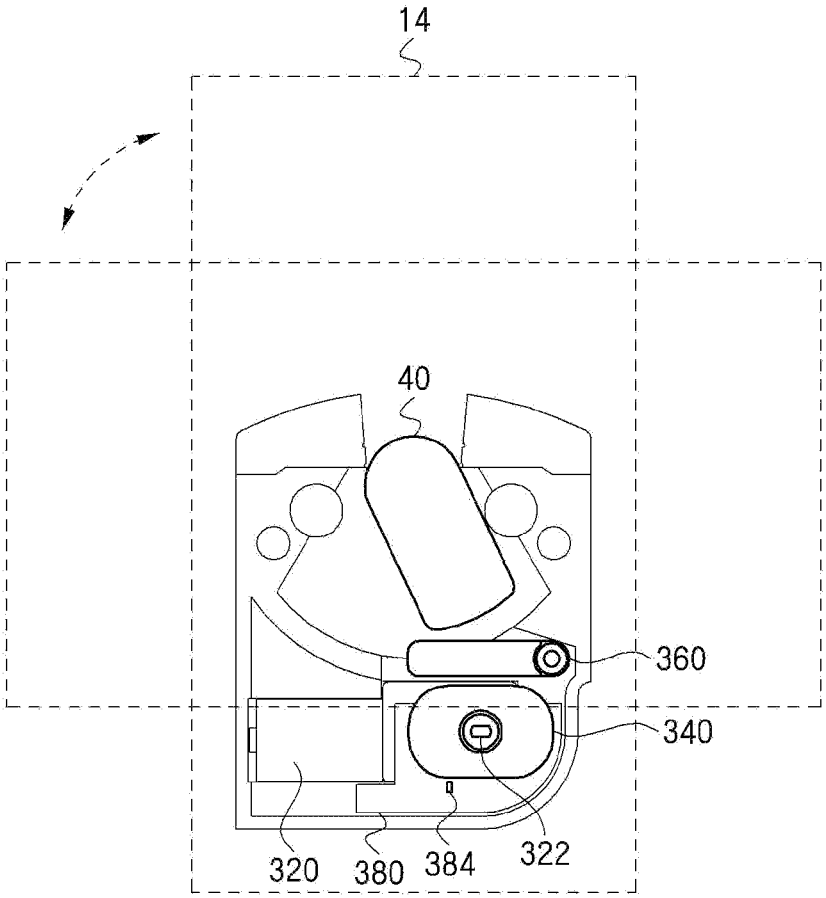

【Figure 12】
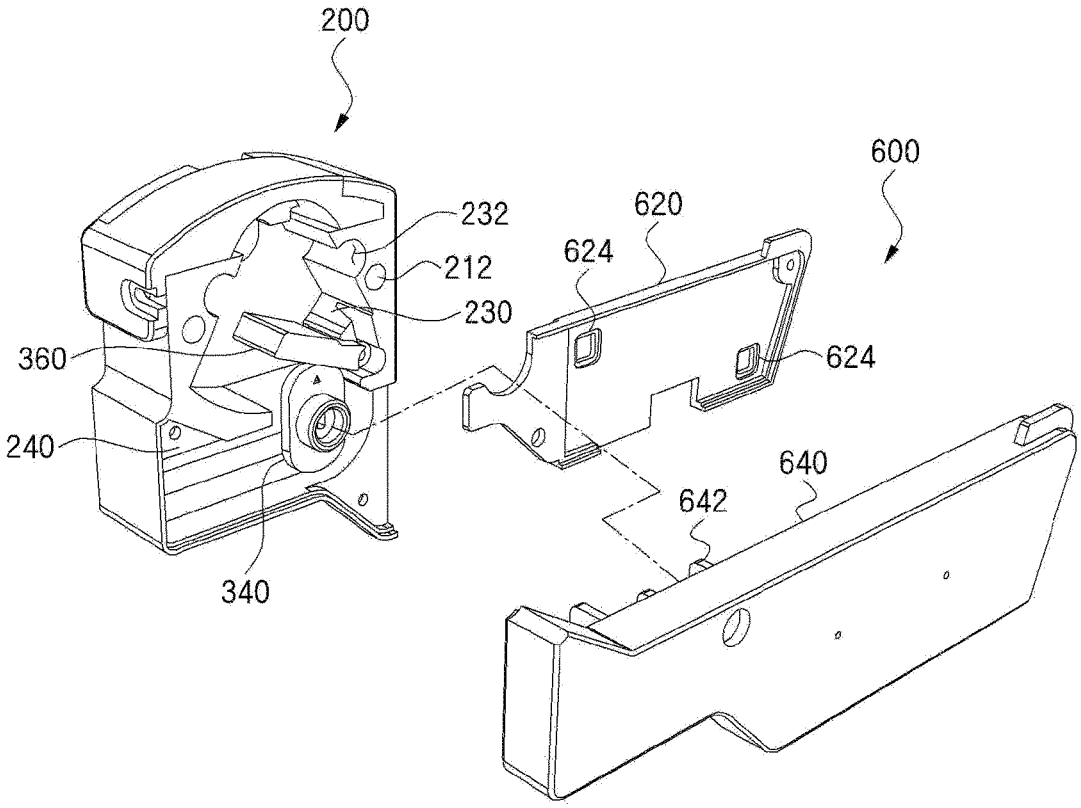

【Figure 13】
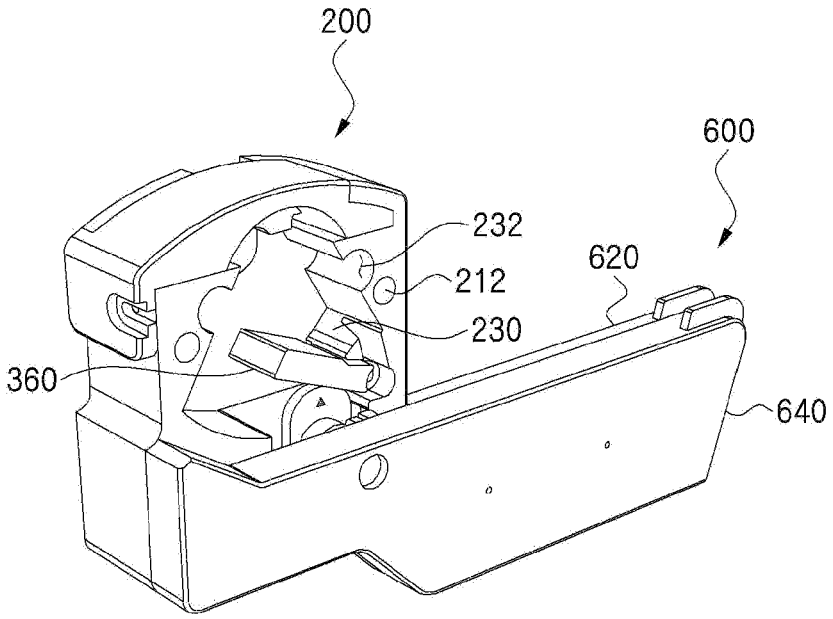

SEAT LOCK

CROSS REFERENCE TO RELATED APPLICATIONS

This application is a National Stage of International Application No. PCT/KR2019/009649 filed Aug. 2, 2019, claiming priority based on Korean Patent Application No. 10-2018-0090725 filed Aug. 3, 2018.

TECHNICAL FIELD

The present invention relates to a seat lock, and more particularly, to a seat lock that is provided with a locking unit adapted to control rotation of a seat.

BACKGROUND ART

Customers in a theater, concert hall, and so on sit in their reserved seat to enjoy contents. After the contents are played, by the way, the customers move to other seats where no customers sit so as to occupy better seats in seeing the contents well.

Such illegal occupation of seats not reserved should be prohibited, and if different prices are given according to seats, especially, customers who rightfully pay the money for their seat and thus sit in their reserved seat are at a disadvantage. Therefore, the illegal seat occupation has to be continuously checked and managed.

However, many labor forces and costs are required to check and manage such illegal occupation of seats not reserved, and also, it is very hard to check whether the customers sit in their reserved seat every time through the labor forces.

The present invention is proposed in view of the above-mentioned problems, that is, to solve the technical problems as mentioned above as well as to provide additional technical components not easily invented by those skilled in the art.

DISCLOSURE

Technical Problem

Accordingly, the present invention has been made in view of the above-mentioned problems occurring in the related art, and it is an object of the present invention to provide a seat lock that is provided with a locking unit adapted to control rotation of a seat.

It is another object of the present invention to provide a seat lock that is provided with a locking unit adapted to limit the movement of a locking piece fixed to a seat.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to the present invention, there is provided a seat lock including: a fixed bracket fixed to a leg of a chair; a locking unit disposed on the fixed bracket; and a movable bracket fixed to a seat of the chair and having a seat rotation shaft and a locking piece coupled to an end periphery of the seat rotation shaft, wherein as the seat of the chair rotates, the movable bracket rotates together with the seat, and the locking unit comprises a latch for selectively limiting a rotational movement of the locking piece.

According to the present invention, desirably, the locking unit includes: a driving motor having a driving motor; a driving cam fitted to the driving shaft of the driving motor; and the latch rotating in a range of a given angle around a shaft fixed to the fixed bracket to limit the rotational movement of the locking piece.

According to the present invention, desirably, the fixed bracket includes: a rotation shaft seating groove formed on top thereof; a locking piece movement space portion formed under the rotation shaft seating groove; and a locking unit accommodation portion formed under the locking piece movement space portion.

According to the present invention, desirably, the driving cam includes a long shaft and a short shaft, and the driving cam pushes up the latch at the time when the long shaft is in a vertical direction with respect to the ground.

According to the present invention, desirably, the locking unit includes a sensor board having at least one or more sensors adapted to sense an operation of the driving cam.

According to the present invention, desirably, the sensor board is disposed between the driving motor and the driving cam.

According to the present invention, desirably, the sensors are located on the sensor board along a driving radius of the driving cam.

According to the present invention, desirably, the sensors include a first sensor located at a position capable of sensing whether the long shaft of the driving cam is in a horizontal direction with respect to the ground and a second sensor located at a position capable of sensing whether the long shaft of the driving cam is in a vertical direction with respect to the ground.

According to the present invention, desirably, a distance between the sensors and the driving cam is in a range of 1.5 to 2.5 mm.

According to the present invention, desirably, each sensor is a light sensor having a light emitting part and a light receiving part.

Advantageous Effects

According to the present invention, the seat lock can utilize the locking unit to allow the seat to be more efficiently managed.

In addition, the seat lock according to the present invention can control the rotation of the seat to permit a customer to sit only in his or her reserved seat, while seeing contents.

The advantageous effects of the present invention are not limited as mentioned above, and other advantageous effects not mentioned herein will be obviously understood by one of ordinary skill in the art through the following description.

DESCRIPTION OF DRAWINGS

FIG. 1 is a perspective view showing a chair to which a seat lock according to the present invention is attached.

FIG. 2 is a perspective view showing a movable bracket of the seat lock according to the present invention.

FIGS. 3A and 3B are front and perspective views showing a fixed bracket of the seat lock according to the present invention.

FIG. 4 is an exploded perspective view showing the fixed bracket on which a locking unit is disposed in the seat lock according to the present invention.

FIG. 5 is a perspective view showing the fixed bracket on which the locking unit is disposed in the seat lock according to the present invention.

FIGS. 6A and 6B are perspective and front views showing the seat lock according to the present invention.

FIG. 7 is a sectional view taken along the line A-A' of FIG. 6B.

FIG. 8 is a front view showing an operation of the seat lock according to the present invention at a first mode.

FIG. 9 is a front view showing an operation of the seat lock according to the present invention at a second mode.

FIG. 10 is a front view showing an operation of the seat lock according to the present invention at a third mode.

FIG. 11 is a front view showing an operation of the seat lock according to the present invention at a fourth mode.

FIG. 12 is an exploded perspective view showing the fixed bracket and a body in the seat lock according to the present invention.

FIG. 13 is a perspective view showing a coupled state of the fixed bracket and the body in the seat lock according to the present invention.

MODE FOR INVENTION

Hereinafter, the present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description. For the convenience of the description, a system and a method will be explained together if necessary.

FIG. 1 is a perspective view showing a chair 10 to which a seat lock 500 according to the present invention is attached.

As shown in FIG. 1, the seat lock 500 according to the present invention is located on a seat 14 and a leg 16 of the chair 10 to control rotation of the seat 14.

First, the chair 10 includes the seat 14 and a back 12. In detail, the seat 14 is a portion with which a hip region of a customer comes into contact and the back 12 is coupledly extended from the seat 14 in a vertical direction to support the customer's back and head regions.

Further, the chair 10 includes legs 16, and the legs 16 serve to support the chair 10.

One seat lock 500 is disposed on one side surface of the seat 14 or two seat locks 500 are disposed on both side surfaces of the seat 14 to control the rotation of the seat 14.

The seat lock 500 largely includes a movable bracket 100, a locking unit 300, and a fixed bracket 200.

Now, an explanation on a configuration of the seat lock 500 according to the present invention will be in detail given with reference to FIGS. 2 to 7.

FIG. 2 is a perspective view showing the movable bracket 100 of the seat lock 500 according to the present invention.

As shown in FIG. 2, the movable bracket 100 is fixed to the side surface of the seat 14 in such a manner as to have a space formed toward the inside of the seat 14.

The movable bracket 100 includes a seat rotation shaft 20 passing through the center thereof and a locking piece 40 coupled to the end periphery of the seat rotation shaft 20 in such a manner as to be exposed to the outside.

In this case, the seat rotation shaft 20 is pierced from one side of the seat 14 to the other.

On the other hand, the movable bracket 100 can rotate together with the rotation of the seat 14.

FIGS. 3A and 3B are front and perspective views showing the fixed bracket 200 of the seat lock 500 according to the present invention.

As shown in FIGS. 3A and 3B, the fixed bracket 200 is fixed to the leg 16 of the chair 10 and includes a rotation shaft seating groove 210, a locking piece movement space portion 230, and a locking unit accommodation portion 240.

According to the present invention, the fixed bracket 200 has a shape of a polygonal block having front, back, top and bottom.

The fixed bracket 200 has the rotation shaft seating groove 210 formed on top thereof.

The rotation shaft seating groove 210 is adapted to seat the seat rotation shaft 20 and is pierced through both surfaces of the fixed bracket 200.

The fixed bracket 200 includes a top insertion hole 220 communicating to a space above the rotation shaft seating groove 210 in such a manner as to be open on top thereof.

The top insertion hole 220 is a hole pierced through both surfaces of the fixed bracket 200 in such a manner as to be extended from the rotation shaft seating groove 210 to top of the fixed bracket 200. In detail, the top insertion hole 220 is pierced from the rotation shaft seating groove 210 to the top of the fixed bracket 200 to allow the seat rotation shaft 20 disposed on the seat 14 to be inserted upward and is also pierced through both surfaces of the fixed bracket 200.

The fixed bracket 200 has at least two bolt coupling holes 212 formed piercedly thereinto.

Through the bolt coupling holes 212, the fixed bracket 200 is coupled to the movable bracket 100.

At the inside of the fixed bracket 200, the locking piece movement space portion 230 is formed to accommodate the locking piece 40 therein at the time when the fixed bracket 200 is coupled to the movable bracket 100.

The locking piece movement space portion 230 serves to provide a space in which the movement of the locking piece 40 is not inhibited at the time when the fixed bracket 200 is coupled to the movable bracket 100. For example, the locking piece movement space portion 230 has a shape of a cone, and a depth of the locking piece movement space portion 230 is greater than heights of the seat rotation shaft 20 and the locking piece 40 fitted to the seat rotation shaft 20.

Further, the locking piece movement space portion 230 has a pair of buffering members (not shown) accommodated therein. The buffering members are made of rubber materials and are fitted to a pair of buffering member coupling grooves 232 formed on the locking piece movement space portion 230.

Next, the locking unit accommodation portion 240 is formed inside the fixed bracket 200.

The locking unit accommodation portion 240 is formed under the locking piece movement space portion 230 to provide a space in which the locking unit 300 as will be discussed later is accommodated.

Now, the locking unit 300 will be in detail explained with reference to FIGS. 4 and 5.

FIG. 4 is an exploded perspective view showing the fixed bracket 200 on which the locking unit 300 is disposed in the seat lock 500 according to the present invention, and FIG. 5 is a perspective view showing the fixed bracket 200 on which the locking unit 300 is disposed in the seat lock 500 according to the present invention.

A driving motor 320 has a driving shaft 322 and is driven by means of a controller (not shown) as will be discussed later.

The driving motor 320 rotates the driving shaft 322 in a clockwise or counterclockwise direction.

A driving cam 340 has a coupling hole 340H formed at the center thereof in such a manner as to be fitted to the driving shaft 322 of the driving motor 320, and a sectional shape of the coupling hole 340H is the same as of the driving shaft 322.

As the driving shaft 322 rotates by means of the driving motor 320, the driving cam 340 rotates in the same direction as the driving shaft 322 of the driving motor 320.

On the other hand, the driving cam 340 has a long shaft a on a curved section and a short shaft b on a horizontal section.

As the driving cam 340 rotates, in this case, it pushes up a latch 360 as will be discussed later at the time when the long shaft a is in a vertical direction with respect to the ground.

Next, the latch 360 is fixed to one surface of the fixed bracket 200 in such a manner as to allow the movement of the locking piece 40 to be selectively limited according to the rotation of the driving cam 340.

In detail, the latch 360 rotates within a given angle around a shaft fixed to the fixed bracket 200. In this case, the given angle is an acute angle.

The latch 360 is located above the driving cam 340 so that it can rotate by means of the rotation of the driving cam 340.

Further, a length of the latch 360 in a horizontal direction with respect to the ground is greater than that of the long shaft of the driving cam 340. In detail, the length of the latch 360 is determined to allow the latch 360 to come into contact with the locking piece 40 at the time when the latch 360 has a maximum angle around the shaft fixed to the fixed bracket 200.

According to the present invention, the locking unit 300 of the seat lock 500 further includes a sensor board 380.

The sensor board 380 is disposed between the driving motor 320 and the driving cam 340 and includes at least one or more sensors 386 for sensing the operation of the driving cam 340.

In this case, the sensors 386 are located on the sensor board 380 along a driving radius of the driving cam 340. For example, the sensors 386 are located at a position capable of sensing whether the long shaft of the driving cam 340 is in the horizontal direction with respect to the ground and at a position capable of sensing whether the long shaft of the driving cam 340 is in the vertical direction with respect to the ground.

Also, the sensors 386 are light sensors, and the light sensors have properties responding to light, that is, photo sensitivity.

In more detail, the light sensors are attached to the sensor board 380 to emit light to the underside of the driving cam 340 and to thus sense the light reflected on the driving cam 340.

To do this, each light sensor 386 includes a light emitting part and a light receiving part.

FIGS. 6A and 6B are perspective and front views showing the seat lock 500 according to the present invention, and FIG. 7 is a sectional view taken along the line A-A' of FIG. 6B.

As shown in FIGS. 6A and 6B, the locking piece 40 of the movable bracket 100 is located between the pair of buffering members, so that while the locking piece 40 is moving, the fixed bracket 200 can be protected from internal damages.

The locking unit 300 is located to limit the movement of the locking piece 40. The latch 360 is disposed under the locking piece 40, and the driving cam 340 is placed under the latch 360.

As shown in FIG. 7, the fixed bracket 200 includes at least one or more steps formed thereon to accommodate the locking unit 300.

For example, the locking unit accommodation portion 240 has at least one more steps adapted to rigidly accommodate the locking unit 300 therein.

On the other hand, the first sensor 382 of the sensors 386 is disposed between the driving motor 320 and the driving cam 340 to face one surface of the driving cam 340, and a distance d between the first sensor 382 and the driving cam 340 is in a range of 1.5 to 2.5 mm.

If the distance d between the first sensor 382 and the driving cam 340 is greater than 1.5 mm, in detail, a quality of sensed result of the first sensor 382 can be ensured, and contrarily, if the distance d between the first sensor 382 and the driving cam 340 is less than 2.5 mm, a high space efficiency can be ensured.

Even if the first sensor 382 is explained in the above, the same explanation will be applied to the second sensor 384 of the sensors 386.

According to the present invention, the seat lock 500 includes the controller.

The controller has a shape of a control board, which is designed separately from the sensor board 380.

The controller serves to control the parts of the seat lock 500.

In more detail, the controller operates the locking unit 300 of the seat lock 500. For example, the controller operates the driving motor 320 so that the driving shaft 322 rotates in at least one direction of clockwise and counterclockwise directions.

Further, the controller acquires the sensed information from the sensors 386 of the sensor board 380 and thus checks whether the seat 14 is locked or not through the sensed information.

In more detail, the controller checks the locking state of the seat 14 according to the operations of the first sensor 382 and the second sensor 384.

In this case, the first sensor 382 is disposed at the position capable of sensing whether the long shaft of the driving cam 340 is in the horizontal direction with respect to the ground, and the second sensor 384 is disposed at the position capable of sensing whether the long shaft of the driving cam 340 is in the vertical direction with respect to the ground.

The controller can check that the seat 14 is in a locked state if the first sensor 382 operates and that the seat 14 is in a rotatable state if the second sensor 384 operates.

Up to now, the configuration of the seat lock 500 according to the present invention has been explained.

Now, a process of controlling the rotation of the seat 14 through the seat lock 500 according to the present invention will be explained with reference to FIGS. 8 to 11, and in more detail, an operation of the locking unit 300 under the controller will be described.

Before the process of controlling the rotation of the seat 14 through the seat lock 500 will be explained, it is assumed that the sensor board 380 includes the first sensor 382 disposed at the position capable of sensing whether the long shaft of the driving cam 340 is in the horizontal direction with respect to the ground and the second sensor 384 disposed at the position capable of sensing whether the long shaft of the driving cam 340 is in the vertical direction with respect to the ground and the seat 14 is schematically shown in checking whether its operation, that is, rotation is performed by the control of the seat lock 500.

According to the present invention, the seat lock 500 can operate at four modes, and hereinafter, the four modes, that is, first, second, third and fourth modes will be explained.

FIG. 8 is a front view showing an operation of the seat lock 500 according to the present invention at the first mode.

The first mode is a standby mode of the seat lock 500. In more detail, the driving motor 320 of the locking unit 300 does not operate, and the long shaft of the driving cam 340 is in the horizontal direction with respect to the ground.

At this time, the latch 360 is disposed parallel to the long shaft of the driving cam 340. Further, the first sensor 382 senses that the long shaft of the driving cam 340 is in the horizontal direction with respect to the ground and thus operates, so that the controller senses the operation of the first sensor 382 to check that the seat 14 is in a rotatable state.

In detail, the seat 14 can freely rotate at the first mode of the seat lock 500.

FIG. 9 is a front view showing an operation of the seat lock 500 according to the present invention at the second mode.

The second mode is an operating mode of the seat lock 500. In more detail, the controller operates the driving motor 320 of the locking unit 300 to allow the driving shaft 322 to rotate in the clockwise direction.

At this time, the driving cam 340 fitted to the driving shaft 322 of the driving motor 320 rotates together in the clockwise direction.

In this case, the long shaft of the driving cam 340 pushes up the latch 360, and the latch 360 rotates within a given angle around the shaft fixed to the fixed bracket 200. In this case, the given angle is an acute angle.

Moreover, the first sensor 382 and the second sensor 384 cannot sense the driving cam 340 because the driving cam 340 rotates, and the controller cannot sense the operations of the first sensor 382 and the second sensor 384, so that the controller checks that the seat lock 500 is currently in the operating mode.

FIG. 10 is a front view showing an operation of the seat lock 500 according to the present invention at the third mode.

The third mode is a locking mode of the seat lock 500. In more detail, the controller stops the operation of the driving motor 320 of the locking unit 300, and because the operation of the driving motor 320 is stopped, the rotation of the driving shaft 322 of the driving motor 320 is finished. Accordingly, the long shaft of the driving cam 340 is in a vertical direction with respect to the ground.

At this time, the latch 360 is movable at a maximum angle around the shaft fixed to the fixed bracket 200 by means of the long shaft of the driving cam 340.

In detail, the latch 360 is located at a position where the movement of the locking piece 40 is limited and thus comes into contact with one surface of the locking piece 40.

Because the long shaft of the driving cam 340 is in the vertical direction with respect to the ground, further, the second sensor 384 senses the driving cam 340 and thus operates, and the controller senses the operation of the second sensor 384, so that the controller checks that the seat lock 500 is limited in rotation, that is, in a locked state.

In case of the third mode of the seat lock 500, like this, the movement of the locking piece 40 on the seat 14 is limited, and accordingly, the seat 14 cannot rotate, so that a customer cannot sit in the corresponding chair.

FIG. 11 is a front view showing an operation of the seat lock according to the present invention at a fourth mode.

The fourth mode is an unlocking mode of the seat lock 500. In more detail, the controller operates the driving motor 320 of the locking unit 300 so that the driving shaft 322 rotates in the counterclockwise direction.

At this time, the driving cam 340 fitted to the driving shaft 322 of the driving motor 320 rotates together in the counterclockwise direction.

In this case, the long shaft of the driving cam 340 pushes down the latch 360, and accordingly, the latch 360 is disposed parallel to the long shaft of the driving cam 340.

Because the long shaft of the driving cam 340 is in the horizontal direction with respect to the ground, further, the first sensor 382 senses the driving cam 340 and thus operates, and the controller senses the operation of the first sensor 382, so that the controller checks that the seat lock 500 is in a rotatable state.

In case of the fourth mode of the seat lock 500, like this, the movement of the locking piece 40 on the seat 14 is not limited, and accordingly, a customer can sit in the corresponding chair.

According to the present invention, the seat lock 500 can control the rotation of the seat 14, while repeatedly performing the first to fourth modes.

Next, an explanation on a coupling relationship between the seat lock 500 and a body 600 according to the present invention will be given with reference to FIGS. 12 and 13, and the repeated explanation on the corresponding parts as mentioned above will be avoided.

Before the body 600 coupled to the seat lock 500 is described, the seat lock 500 is schematically illustrated with respect to the fixed bracket 200 to allow the coupled state to the body 600 to be understood well.

FIG. 12 is an exploded perspective view showing the fixed bracket 200 and the body 600 in the seat lock 500 according to the present invention, and FIG. 13 is a perspective view showing a coupled state of the fixed bracket 200 and the body 600 in the seat lock 500 according to the present invention.

As shown in FIG. 12, the body 600 includes a first body 620 and a second body 640, and the first body 620 is disposed on a portion of the fixed bracket 200 in such a manner as to be extended outward from the fixed bracket 200.

The first body 620 includes the control board (not shown) located therein and one or more holes 624 formed thereon to couple the control board thereto. In this case, the control board is connected in the first body 620 to the sensor board and the driving motor 320 and controls the locking unit 300 of the seat lock 500.

Also, the second body 640 is coupled to the first body 620 and is disposed on a portion of the seat lock 500 in such a manner as to be attached to the leg of the chair. For example, the second body 640 is disposed on a portion of the locking unit accommodation portion 240 of the fixed bracket 200 in such a manner as to be extended outward from the seat lock 500.

The second body 640 includes a groove 642 adapted to prevent the movement of the locking unit 300 located on a lower portion of the seat lock 500 from being inhibited. In this case, the groove 642 is fittedly coupled to the center of the driving cam 340 and is formed inside the second body 640 to prevent the rotation of the driving cam 340 from being inhibited.

As shown in FIG. 13, the fixed bracket 200 is coupled to the body 600 so that it can be rigidly attached to the chair.

In this case, the body 600 serves to protect the seat lock 500 from external impacts and to allow the seat lock 500 to be rigidly attached to the chair.

Up to now, the seat lock 500 according to the present invention has been explained.

According to the present invention, the seat lock 500 can limit the rotation of the seat, so that the seats in theaters, concert halls, and so on can be more efficiently managed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A seat lock comprising:

a fixed bracket fixed to a leg of a chair;

a locking unit disposed on the fixed bracket; and a movable bracket fixed to a seat of the chair and having a seat rotation shaft and a locking piece coupled to an end periphery of the seat rotation shaft, wherein as the seat of the chair rotates, the movable bracket rotates together with the seat, and the locking unit comprises a latch for selectively limiting a rotational movement of the locking piece, and wherein the locking unit comprises:

a driving motor having a driving shaft;

a driving cam fitted to the driving shaft of the driving motor; and the latch rotating in a range of a given angle around a shaft fixed to the fixed bracket to limit the rotational movement of the locking piece.

2. The seat lock according to claim 1, wherein the driving cam comprises a long shaft and a short shaft, and the driving cam pushes up the latch at the time when the long shaft is in a vertical direction with respect to the ground.

3. The seat lock according to claim 1, wherein the fixed bracket comprises:

a rotation shaft seating groove formed on top thereof;

a locking piece movement space portion formed under the rotation shaft seating groove; and a locking unit accommodation portion formed under the locking piece movement space portion.

4. The seat lock according to claim 1, wherein the locking unit comprises a sensor board having at least one or more sensors adapted to sense an operation of the driving cam.

5. The seat lock according to claim 4, wherein each sensor is a light sensor comprising a light emitting part and a light receiving part.

6. The seat lock according to claim 4, wherein the sensor board is disposed between the driving motor and the driving cam.

7. The seat lock according to claim 6, wherein a distance between the sensors and the driving cam is in a range of 1.5 to 2.5 mm.

8. The seat lock according to claim 4, wherein the sensors are located on the sensor board along a driving radius of the driving cam.

9. The seat lock according to claim 8, wherein the sensors comprise a first sensor located at a position capable of sensing whether a long shaft of the driving cam is in a horizontal direction with respect to the ground and a second sensor located at a position capable of sensing whether the long shaft of the driving cam is in a vertical direction with respect to the ground.

* * * * *